United States Patent [19]

Boe et al.

[11] Patent Number: 4,964,014

[45] Date of Patent: Oct. 16, 1990

[54] SOLENOID VALVE DRIVER

[75] Inventors: Thomas E. Boe, Grundy County; Vijay M. Dharia, Cedar Falls, both of Iowa

[73] Assignee: Deere & Company, Moline, Ill.

[21] Appl. No.: 294,527

[22] Filed: Jan. 6, 1989

[51] Int. Cl.[5] ..... H01H 47/22

[52] U.S. Cl. ..... 361/187; 361/171

[58] Field of Search ..... 361/187, 160, 166, 170, 361/171, 172, 185, 186

[56] References Cited

U.S. PATENT DOCUMENTS

| | | | |
|---|---|---|---|
| 4,173,259 | 11/1979 | Heckenkamp | 172/10 |
| 4,618,908 | 10/1986 | Anttila | 361/187 |
| 4,661,766 | 4/1987 | Hoffman et al. | 361/160 |
| 4,737,882 | 4/1988 | D'Onofrio | 361/160 |
| 4,817,499 | 4/1989 | Bellanger et al. | 91/361 |

FOREIGN PATENT DOCUMENTS

| | | |
|---|---|---|
| 2916322 | 11/1980 | Fed. Rep. of Germany . |
| 3338764 | 5/1985 | Fed. Rep. of Germany . |
| 2548840 | 1/1985 | France . |
| 2037102 | 7/1980 | United Kingdom . |

OTHER PUBLICATIONS

Steiger, "TPH Operating Information", pp. 12-1 to 12-8 JI Case, "Electronic Hitch Alignment", pp. 8009-3 to 8009-3 to 8009-13 and 8010-10 to 8010-13, 1988.

M. Venturini & M. Maytum, "Permanent Magnet DC Motor Control" Power Conversion International, Jul.-/Aug. 1983, pp. 55-57.

J. Hobbs and H. Hesse, "Electronic/Hydraulic Hitch Control for Agricultural Tractors", 1980, SAE Paper 801018, International Off-Highway Meeting & Expo. Mecca, Milwaukee, Sep. 8-11, 1980.

*Primary Examiner*—A. D. Pellinen
*Assistant Examiner*—J. Gaffin

[57] ABSTRACT

A solenoid current control system includes a microprocessor which periodically generates a desired peak current value and which energizes the solenoid coil. Current through the coil is sensed via a series resistor and the sensed current is compared to the desired peak current by comparator. The comparator generates an interrupt signal when the sensed current reaches the desired peak value. The interrupt signal is applied to the microprocessor which responds by de-energizing the coil.

3 Claims, 7 Drawing Sheets

SOLENOID VALVE DRIVER

BACKGROUND OF THE INVENTION

This application includes a microfiche appendix including 2 microfiche and 140 frames.

A portion of the disclosure of this patent document contains material which is subject to a claim of copyright protection. The copyright owner has no objection to the facsimile reproduction by anyone of the patent document or the patent disclosure as it appears in the Patent and Trademark Office patent file or records, but otherwise reserves all other rights whatsoever.

This invention relates to a control system for controlling the electrical current supplied to a solenoid, such as the solenoid of a solenoid-operated hydraulic control valve.

It is known to use a pulse-width modulation technique to control the current supply to the solenoid coils of electrohydraulic valves. This is a voltage control technique, but because solenoid forces are proportional to solenoid current, a method of compensating for variations in supply voltage and coil resistance is required, for example, an operator-adjustable sensitivity control. Another known method of controlling solenoid current is to provide a current feedback sensor in series with the coil. This current is sensed by means of a comparator which turns the driver off when the coil current exceeds a reference level and turns the driver back on when the current drops below the reference level. The hysteresis of the comparator circuit provides a controllable off and on time for this circuit. This valve driver method will provide an accurate control of the average solenoid current for both varying supply voltages and varying coil resistances. However, the cost and number of electronic components to achieve this method can be significantly greater than the pulse width modulation method. Accordingly, a low cost and effective system for controlling solenoid current is desired.

SUMMARY OF THE INVENTION

An object of the present invention is to provide a system for controlling solenoid current which is simple and inexpensive.

Another object of the present invention is to provide such a current control system which can detect a solenoid open circuit condition.

These and other objects are achieved by the present invention wherein a microprocessor periodically generates a desired peak current value and energizes the solenoid coil. A voltage representing the desired peak current value is applied to an input of a comparator. Current through the coil is sensed via a series resistor and a voltage representing the sensed current is applied to the other input of the comparator. The comparator generates an interrupt signal when the sensed current reaches the desired peak value. The interrupt signal is applied to the microprocessor which responds by causing the ground potential to be disconnected from the solenoid. If no interrupt signal is received, the desired peak current value is reduced, and the comparison is repeated. If still no interrupt signal is generated, the desired peak value is again reduced and the comparison is again repeated. If still no interrupt signal is generated, a signal is generated indicating an open circuit condition of the solenoid.

This peak current detection method provides an approximate control of the solenoid current with a parts count (and therefore cost) which is typically lower than other current compensation driver methods. Because the off time is controlled by microprocessor software, modulation frequencies can be conveniently adjusted. The parts count is reduced because the sense resistor can be placed in the switched ground of the coil and because the comparator hysteresis is not required. This method of modulation control provides the additional feature that coil short circuit will be self-limiting since the average current of a pure resistive load is much lower than the peak current. Further, software has been added to detect open circuits by the absence of the peak current interrupt.

DETAILED DESCRIPTION

Figure 1A:
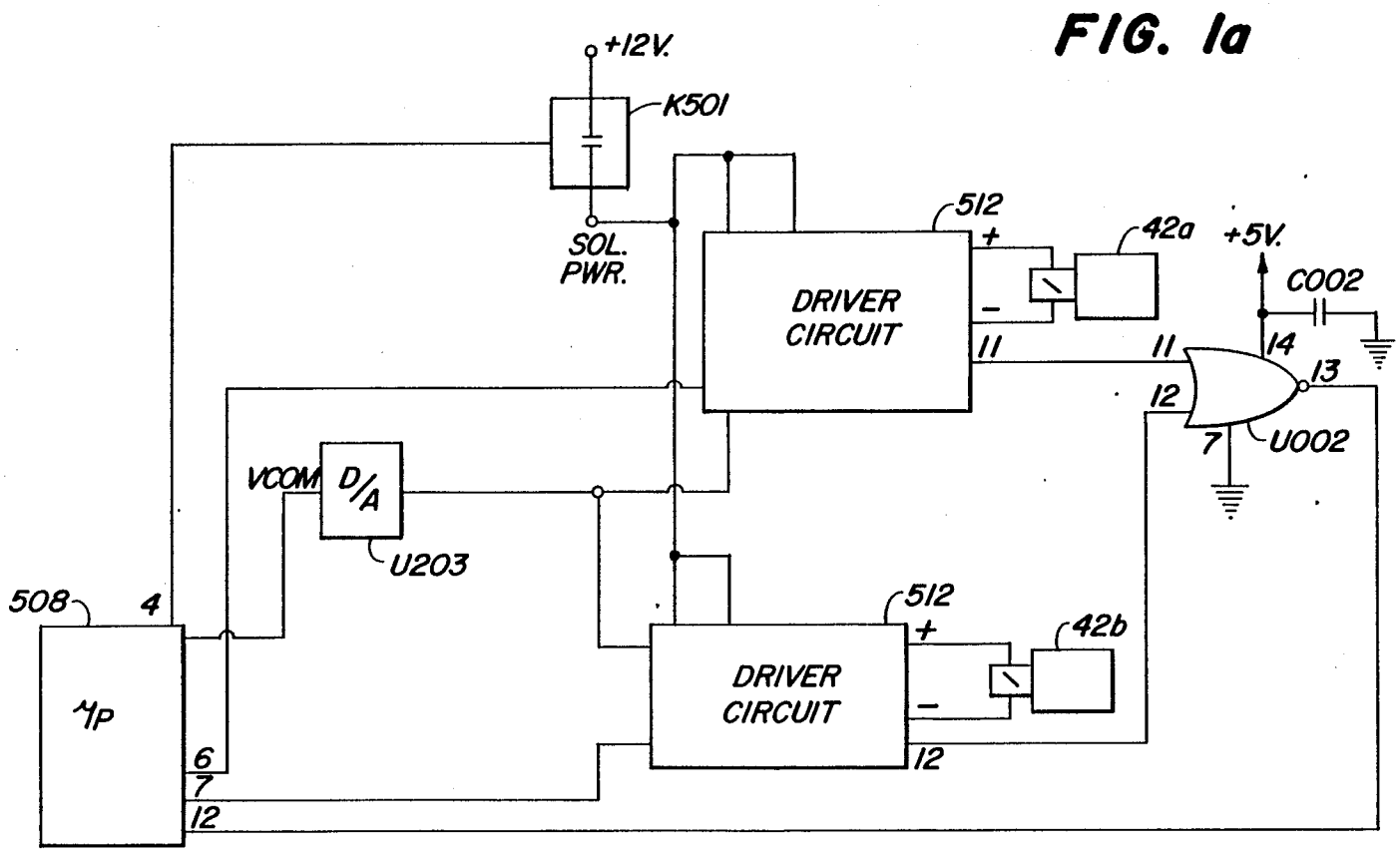
FIG. 1*a* is a simplified schematic block diagram of the present invention.
Figure 1B:
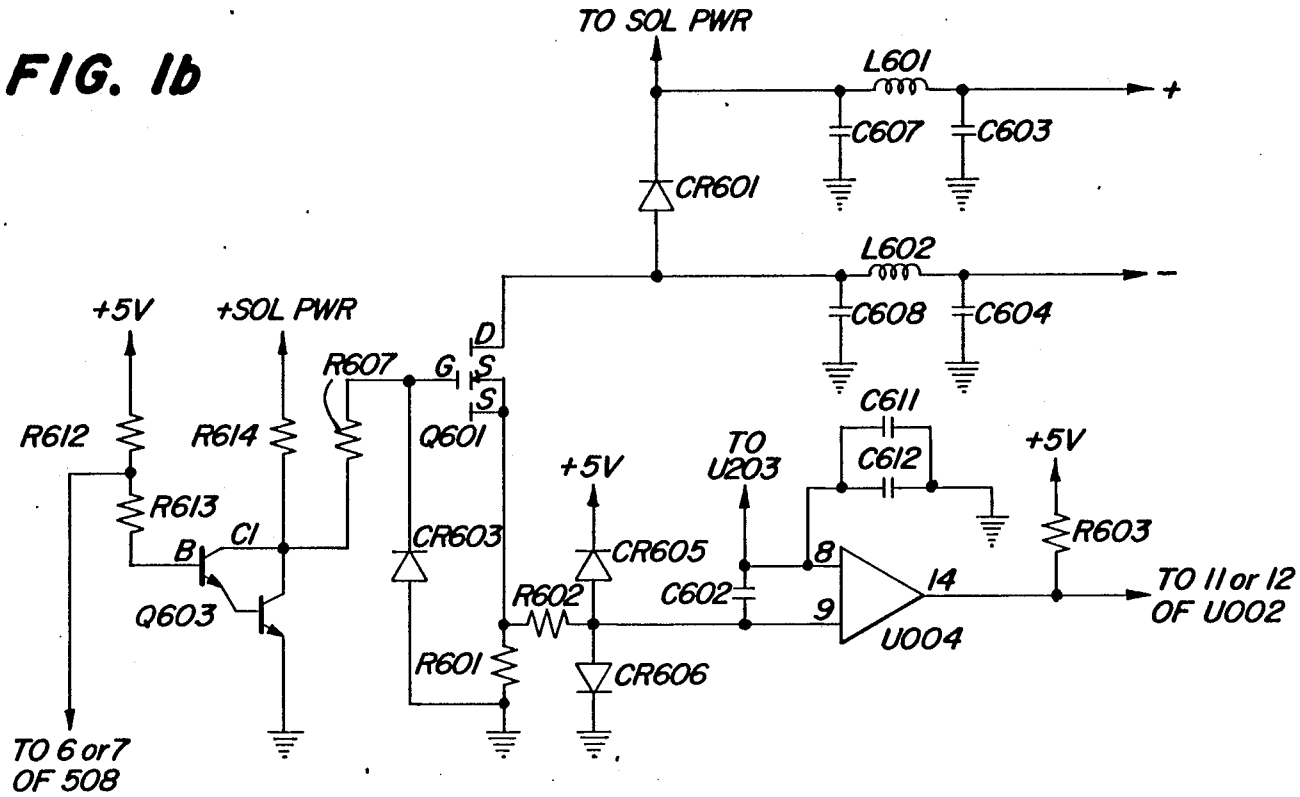
FIG. 1*b* is a detailed circuit diagram of the driver circuits of FIG. 1*a*.

Referring to FIGS. 1*a* and 1*b*, the valves 42*a* and 42*b* are each driven by indentical valve driver circuits 512 which are connected to +12 volts via relay K501, to the microprocessor 508 D/A converter U203, to microprocessor pins 6 and 7 and to NAND gate U002. For more detailed information concerning these circuit schematics, reference is made to the following component lists:

| | |
|---|---|
| Diodes | |
| CR601 | Ultra-fast Rectifier, MUR410 |
| CR603 | Zener, IN4745, 16 volt |
| CR605, CR606 | Dual Diode SOT-23, BAV99 |
| Integrated Circuits | |
| U203 | 8 bit D to A converter, AD558 |
| U002 | Quad NOR, 74HCO2 |
| U004 | Comparator, LM2901 |
| Transistors | |
| Q601 | POWER MOSFET, BUZ11 |
| Q603 | NPN Darlington, MPS A29 |
| Resistors | |
| R612 | 5.6 k Ohm 1/8 W |
| R613 | 330 Ohm 1/8 W |
| R614 | 750 Ohm 1 W |
| R607 | 120 Ohm 1/8 W |
| R601 | wirewound .75 Ohm 7 W |
| R602 | 1.0 k Ohm 1/8 W |
| R603 | 4.7 k Ohm 1/8 W |
| Capacitors | |
| C602 | 150 pF 50 v |
| C603 | .001 micro F 100 v |
| C604 | .001 micro F 100 v |
| C607 | .001 micro F 100 v |
| C608 | .001 micro F 100 v |
| C611 | .047 micro F 50 v |
| C612 | .047 micro F 50 v |
| C002 | .01 micro F 100 v |
| Inductors | |
| L601 | Axial Ferrite Bead |
| L602 | Axial Ferrite Bead |

Figure 2A:
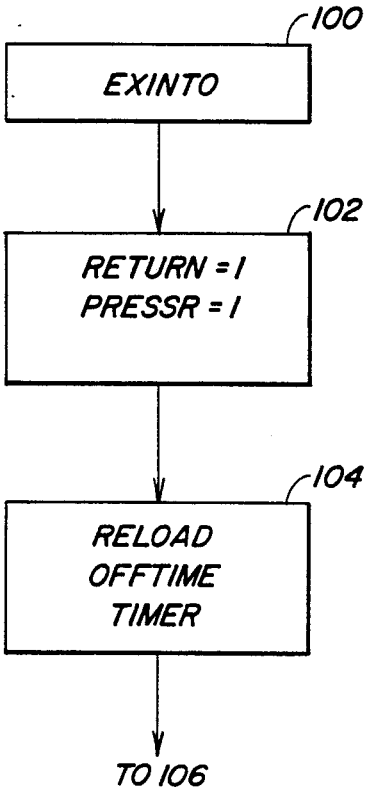
FIGS. 2*a*, 2*b* and 3*a*–3*c* are flow charts of algorithms performed by the microprocessor of FIG. 1*a*.
Figure 2B:
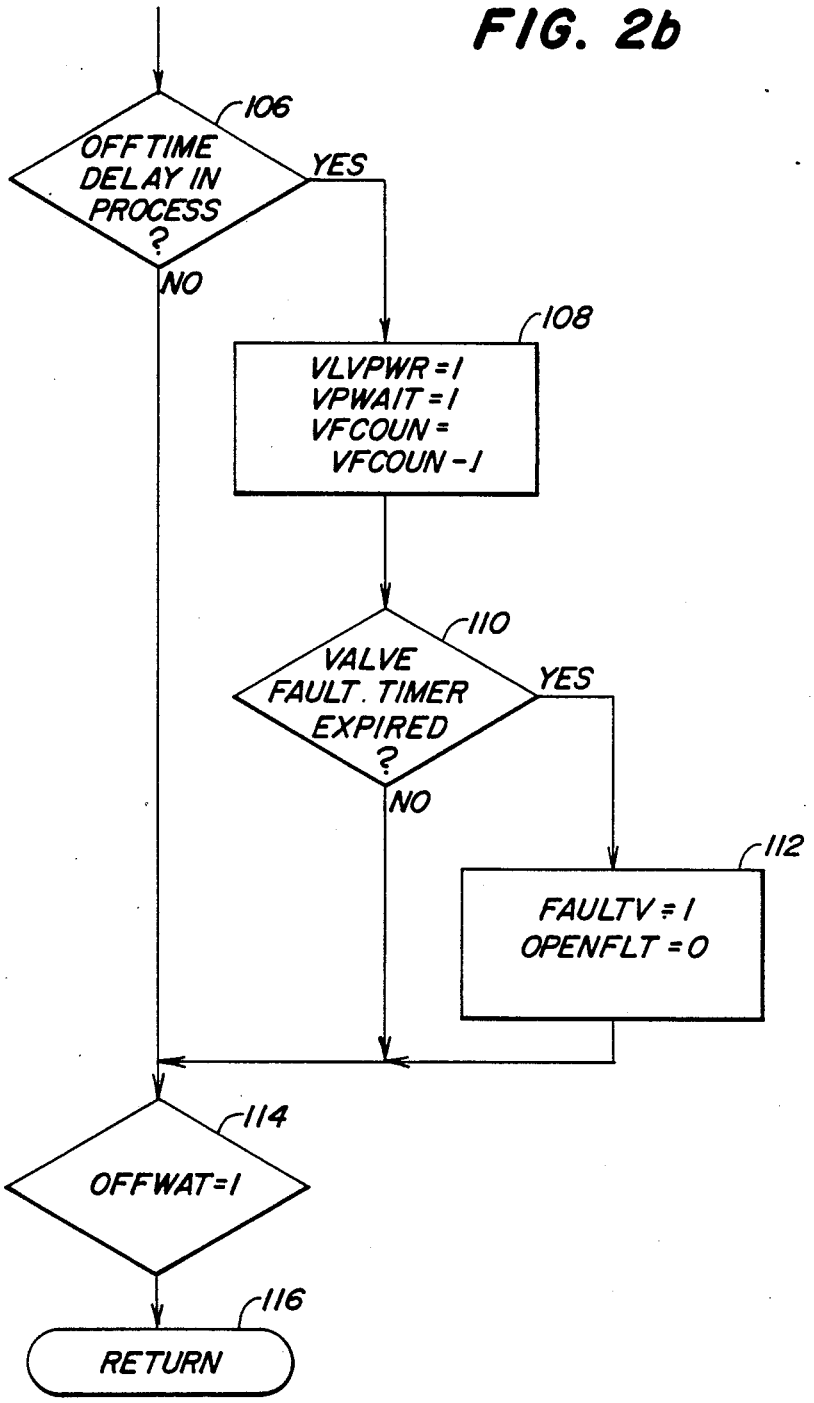

In cooperation with the valve driver circuitry shown in FIGS. 1*a* and 1*b*, the microprocessor periodically executes valve driver subroutines (see FIGS. 2*a* and 2*b*) which operate as follows: a peak valve current reference value, VCOM, is supplied to the (−) input of comparator U004 via D/A converter U203. Then, the microprocessor generates a signal (at pin 6 or 7) which turns transistor Q601 on so that current flows through the solenoid coil of valve 42*a* or 42*b*. When the current through the solenoid coil (sensed via resistor R601) reaches the peak value represented by VCOM, the output of comparator U004 toggles, thus supplying an interrupt signal to pin 12 of the microprocessor. This interrupt signal causes entry into entry step 100 of the peak detection subroutine (steps 100–116) shown in FIGS. 2*a* and 2*b*. Then, in step 102, this subroutine generates a signal which causes transistor Q601 to open, thus cutting off the current to the solenoid coil for a predetermined time period determined by steps 104–116.

Figure 3A:
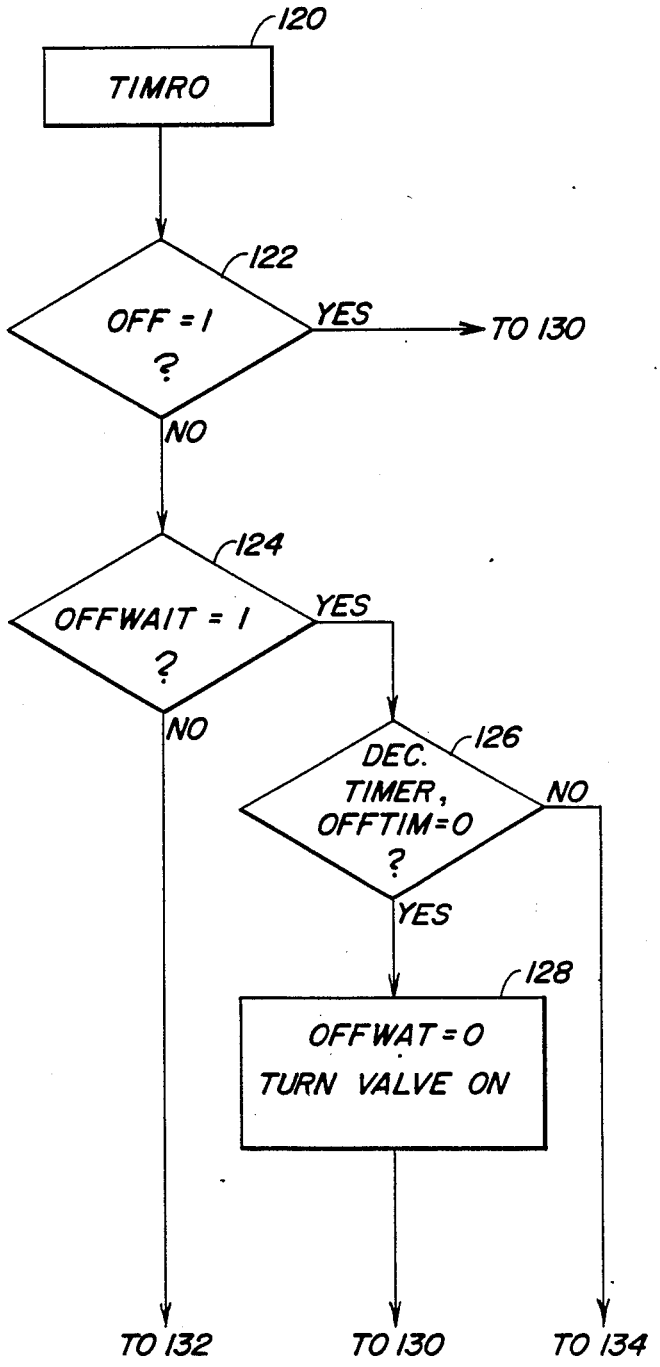
Figure 3B:
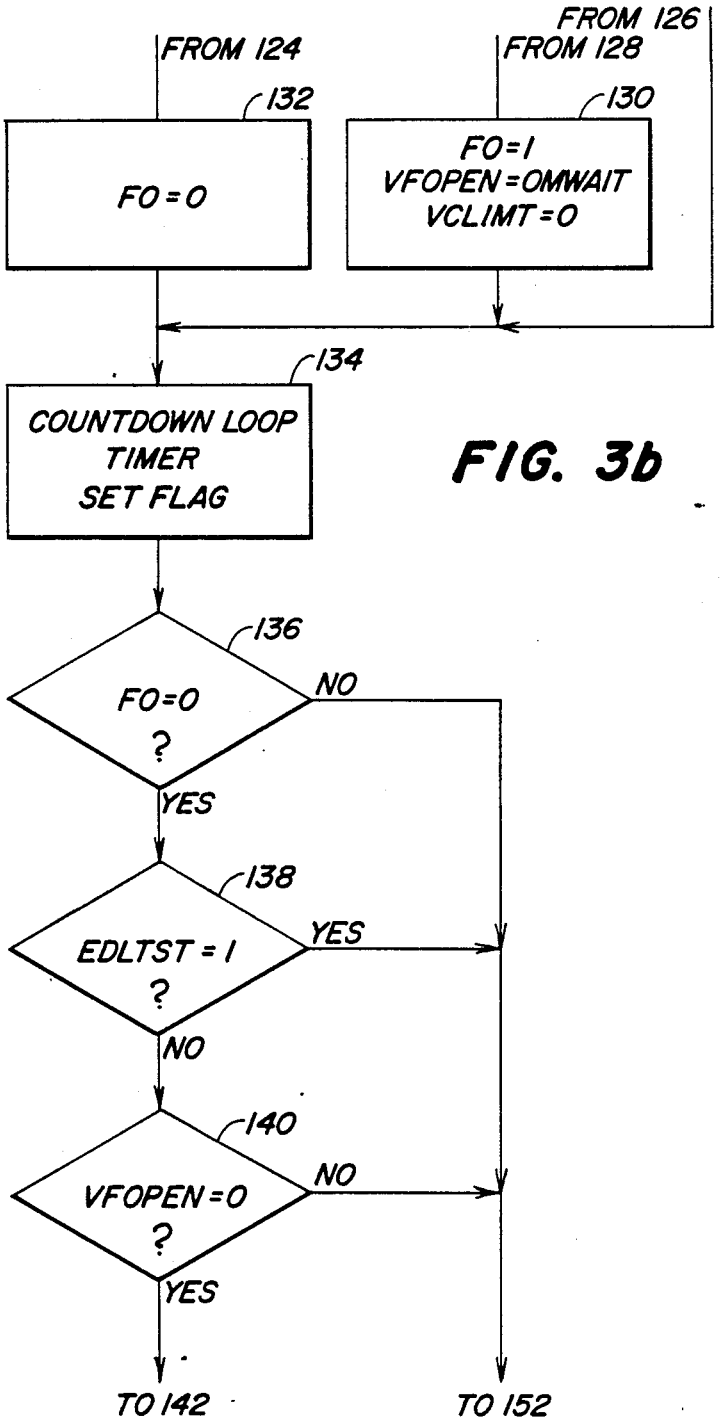
Figure 3C:
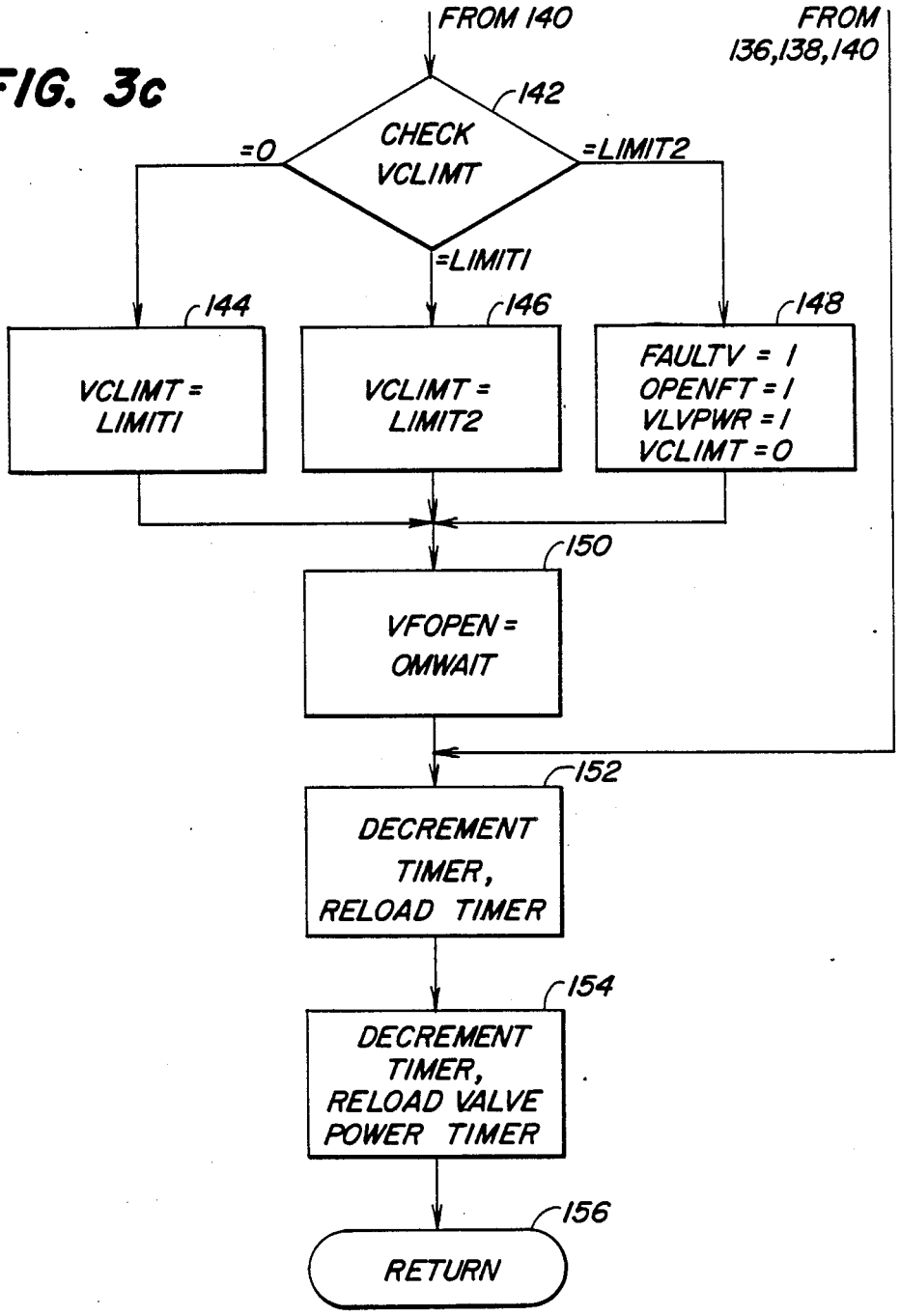

The microprocessor also detects open circuit conditions of the solenoid coils by twice reducing the peak valve current reference value if no interrupt signal is received within a certain time interval. If the sensed valve current fails to reach this twice-reduced reference current level and still no interrupt is received within an additional time period, then an open circuit alarm signal is generated. This is accomplished by execution of the timer subroutine (steps 120–156) shown in FIGS. 3*a*–3*c*.

The timer subroutine is entered at step 120 as a result of an interrupt signal generated every 80 microseconds. Then, step 122 determines whether both valves are off. If yes, then the algorithm proceeds to step 130. If no, then the algorithm proceeds to step 124. Step 124 determines whether an off-time wait is in process. If yes, then the algorithm proceeds to step 26. If not, then the algorithm proceeds to step 132. Step 126 decrements an off timer and determines if it has expired. If not, the algorithm proceeds to step 134, otherwise, the algorithm proceeds to step 128. Step 128 sets a flag to indicate that the off-time wait is not in process and turns the appropriate valves on.

Step 130 indicates that the peak current interrupt is not pending, reinitializes an open circuit timer, and indicates no current limit. On the other hand, step 132 indicates that no peak current interrupt has occurred. Step 134 counts down the main loop timer and sets a time base flag if the timer has expired. Next, step 136 checks to see if the algorithm is waiting for a peak current interrupt. If not, the algorithm proceeds to step 152. If yes, the algorithm proceeds to step 138 which asks, "Is this an end of the line test?". If yes, then the algorithm again proceeds to step 152. If not, the algorithm proceeds to step 140. Step 140 counts down an open circuit timer and determines if that timer has expired. If not, the algorithm proceeds to step 152 and if yes, the algorithm proceeds to step 142.

Step 142 checks the current limit value and, depending upon the current limit value, directs the algorithm to either step 144, 146, or 148. For example, if the current limit value is zero, indicating that no current limit is being utilized, then the algorithm is directed to step 144 which sets the current limit to the maximum value. If, in step 142, the current limit is equal to the maximum limit value, then the algorithm is directed to step 146 which reduces the current limit value to a lower value. If, in step 142, the current limit value is equal to the lower limit value, then the algorithm proceeds to step 148 which sets fault flags to indicate that an open circuit fault condition has occurred and turns off the valve power by opening relay K501 and resets the current limit to zero.

Following steps 144, 146 or 148, step 150 reloads the open circuit timer, steps 152 and 154 decrement or reload, as the case may be, other timers. Finally, step 156 returns control out of this subroutine.

A valve subroutine (not illustrated by a flow chart, but included in the computer program listing in the microfiche appendix) operates to set the peak current level (by means of D/A converter U203) and sets flags to indicate to the timer routine which valve to turn on. This valve subroutine also controls the length of the time interval (DELAY) during which the valves are turned off by deriving DELAY from the following relationship:

$$DELAY = G80 - VCOM \times G81/256,$$

where G80 and G81 are predetermined constants.

Thus, it can be seen that this "off time" interval will decrease as the peak valve current reference value, VCOM, increases.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

What is claimed is:

1. A system for controlling an electrical current applied to a coil of a solenoid, comprising:
   - means for periodically energizing the coil;
   - means for sensing actual current through the coil;
   - means for generating a reference current value corresponding to a desired peak coil current;
   - means for comparing the actual current to the reference current value and for generating a first signal when the actual current reaches the reference current value;
   - means for periodically de-energizing the coil in response to generation of the first signal; and
   - means for reducing the reference current value if no first signal is generated within a certain time period.

2. The current control system of claim 1, further comprising:
   - means for generating a second signal if actual coil current does not reach the reduced reference current value within a predetermined time period.

3. A system for controlling an electrical current applied to a coil of a solenoid, comprising:
   - means for periodically energizing the coil;
   - means for sensing actual current through the coil;
   - means for generating a reference current value corresponding to a desired peak coil current;
   - means for comparing the actual current to the reference current value and for generating a first signal when the actual current reaches the reference current value;
   - means for periodically de-energizing the coil in response to generation of the first signal; and
   - means for re-energizing the coil a predetermined time after the de-energization of the coil, wherein the predetermined time decreases as a function of increasing reference current value.

* * * * *